US006285851B1

(12) United States Patent
Kojima et al.

(10) Patent No.: US 6,285,851 B1
(45) Date of Patent: Sep. 4, 2001

(54) CLEANING APPARATUS WHICH INCLUDES CLEANING MEMBER, SUPPORTING PORTION AND REINFORCING MEMBER

(75) Inventors: Hisayoshi Kojima, Mishima; Kazunari Murayama; Tomonori Mori, both of Shizuoka, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/343,254

(22) Filed: Jun. 30, 1999

(30) Foreign Application Priority Data

Jul. 3, 1998 (JP) ..... 10-204481

(51) Int. Cl.[7] ..... G03G 21/00
(52) U.S. Cl. ..... 399/350; 399/351
(58) Field of Search ..... 399/123, 350, 399/351

(56) References Cited

U.S. PATENT DOCUMENTS 4,803,752 * 2/1989 Kasama ..... 399/350 X
4,969,015 * 11/1990 Sanpe ..... 399/351 X
5,363,182 * 11/1994 Kuribayashi et al. ..... 399/350
5,479,250 12/1995 Michlin .
5,517,294 * 5/1996 Ogiri et al. ..... 399/351

FOREIGN PATENT DOCUMENTS 0 703 511A2 3/1996 (EP) .
62-9382 1/1987 (JP) .
8-185098 7/1996 (JP) .

OTHER PUBLICATIONS

Patent Abstracts of Japan, Kokai No. 8–185098.
Patent Abstracts of Japan, Kokai No. 62–9382.
European Search Report.

* cited by examiner

*Primary Examiner*—William J. Royer
(74) *Attorney, Agent, or Firm*—Fitzpatrick, Cella, Harper & Scinto

(57) ABSTRACT

A cleaning apparatus includes a cleaning member for removing residual toner from an image bearing member. A supporting portion for supporting the cleaning member, the supporting portion being of a material different from that of the cleaning member. A reinforcing member, wherein the reinforcing member and the cleaning member sandwich the supporting portion.

29 Claims, 4 Drawing Sheets

CLEANING APPARATUS WHICH INCLUDES CLEANING MEMBER, SUPPORTING PORTION AND REINFORCING MEMBER

FIELD OF THE INVENTION AND RELATED ART

The present invention relates to a cleaning apparatus employed by an image forming apparatus based on an electrophotographic system or an electrostatic recording system. It also relates to a process cartridge removably installable in an image forming apparatus.

An image forming apparatus, such as a printer, records an image on an image bearing member through the following steps: uniformly charging an image bearing member by a charging device; forming a latent image on the uniformly charged image bearing member by selectively exposing the image bearing member; developing the latent image into a visible image with the use of a developing device and developer, and transferring the developed (visual) image onto a piece of recording medium. After the image transfer, the developer which remains on the image bearing member is removed and collected into a cleaning means container by a cleaning blade, so that the following image formation cycle is carried out with the use of the same image bearing member with a clean surface.

In recent years, the maintenance for an image forming apparatus has been simplified with the employment of a cartridge system, according to which the aforementioned image bearing member, charging device, developer, cleaning means, waste developer bin, and the like are integrated in the form of a cartridge, which can be removably installed in the main assembly of an image forming apparatus so that the developer, or components such as the image bearing member, can be easily replaced by replacing the cartridge in the main assembly with a new cartridge. Further, as the service life of an image bearing member has become longer, that is, as the number of copies producable during the service life of a single image bearing member has increased, a cartridge such as the one described above has been separated into two independent units: a development means cartridge, and a drum cartridge, which can both be removably installed into the main assembly of an image forming apparatus as can the aforementioned process cartridge, so that the image forming apparatus can be easily maintained, and the main components can be replaced in accordance with the individual lengths of their service lives. The developing means cartridge is limited in terms of developer supply. The drum cartridge integrally comprises an image bearing member, and image processing means, that is, a charging means and a cleaning means. The waste developer, which is generated as the image bearing member is cleaned in the drum cartridge, is collected in a part of a cleaning means container (housing), the waste toner capacity of which is large enough to match the length of the service life of the image bearing member. Thus, the waste toner is removed from the main assembly as the drum cartridge is replaced with a fresh cartridge.

The cleaning means generally comprises a blade for removing the waste developer. The blade consists of a support portion formed of metallic plate, and an edge portion, that is, a contact portion formed of elastic material such as rubber. In order to clean the peripheral surface of the image bearing member, the blade is placed in contact with the peripheral surface of an image bearing member in such a manner that the blade hypothetically invades the peripheral surface of the image bearing member by a predetermined depth. If this depth in the hypothetical invasion is improper, the cleaning blade fails to properly clean the image bearing member, or is bent backward. Therefore, the depth of the hypothetical invasion must be very accurately maintained.

However, any change in the internal ambience of an image forming apparatus creates problems. For example, as the internal temperature of the apparatus fluctuates, the aforementioned hypothetical depth also fluctuates since the material of the housing in which the cleaning section is disposed expands or shrinks in response to the temperature fluctuation. This problem is more apparent if the housing is formed of resin. Further, this fluctuation in the depth of the hypothetical blade invasion also occurs due to the difference in coefficient of linear thermal expansion between the material (resin) of the housing and the material (metallic plate) of the cleaning blade. Further, the fluctuation in the depth of the hypothetical blade invasion sometimes occurs due to the microscopic deformation (for example, twisting) caused by external physical force, such as the force effected by the other members (for example, development sleeve or development roller) which also make contact with the image bearing member.

In order to prevent the occurrence of such change in the depth of the hypothetical blade invasion into the image bearing member, various attempts have been made. For example, material other than resin was used as the material for the housing, and/or the rigidity of the housing was increased by increasing the thickness of the housing wall or by the addition of ribs to the wall.

On the other hand, the trend has been to reduce the particle size of toner, that is, developer, to an extremely small size, in order to produce an extremely precise image. In order to remove such toner that is extremely small in particle diameter, with the same degree of efficiency as the efficiency with which toner of a conventional size is removed, the fluctuation of the aforementioned depth of hypothetical invasion of the cleaning blade must be reduced to a much lower level than the level in the past. In a situation such as this, the reduction in the fluctuation of the depth of the hypothetical invasion of the cleaning blade, which can be accomplished simply by increasing the rigidity of the cleaning means housing itself, is not enough to remove the recent toner composed of extremely small particles, as efficiently as the conventional toner can be removed.

SUMMARY OF THE INVENTION

The primary object of the present invention is to provide an image forming apparatus which employs a cleaning apparatus or a process cartridge in which the positional accuracy of the cleaning member relative to the cleaning means housing is prevented from fluctuating due to temperature fluctuation and/or external physical force.

Another object of the present invention is to provide a cleaning apparatus which comprises: a cleaning member for removing the residual toner on the image bearing member; a supporting portion to which said cleaning member is attached to be supported; and a reinforcement member, wherein said cleaning member supporting portion is formed of material different from the material of said cleaning member, and said reinforcement member is positioned so that the base portion of said cleaning member is sandwiched between said reinforcement member and said cleaning member supporting portion of the cleaning means housing.

Another object of the present invention is to provide a process cartridge which comprises: an image bearing member; a cleaning member for removing the residual toner on the image bearing member; a supporting portion to which said cleaning member is attached to be supported; and a reinforcement member, wherein said cleaning member supporting portion is formed of material different from the material of said cleaning member, and said reinforcement member is positioned so that the base portion of said cleaning member is sandwiched between said reinforcement member and said cleaning member supporting portion of the cleaning means housing.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, an image forming apparatus in accordance with the present invention will be described with reference to the appended drawings.

EMBODIMENTS

Embodiment 1

[General Structure of Image Forming Apparatus]

Figure 1:
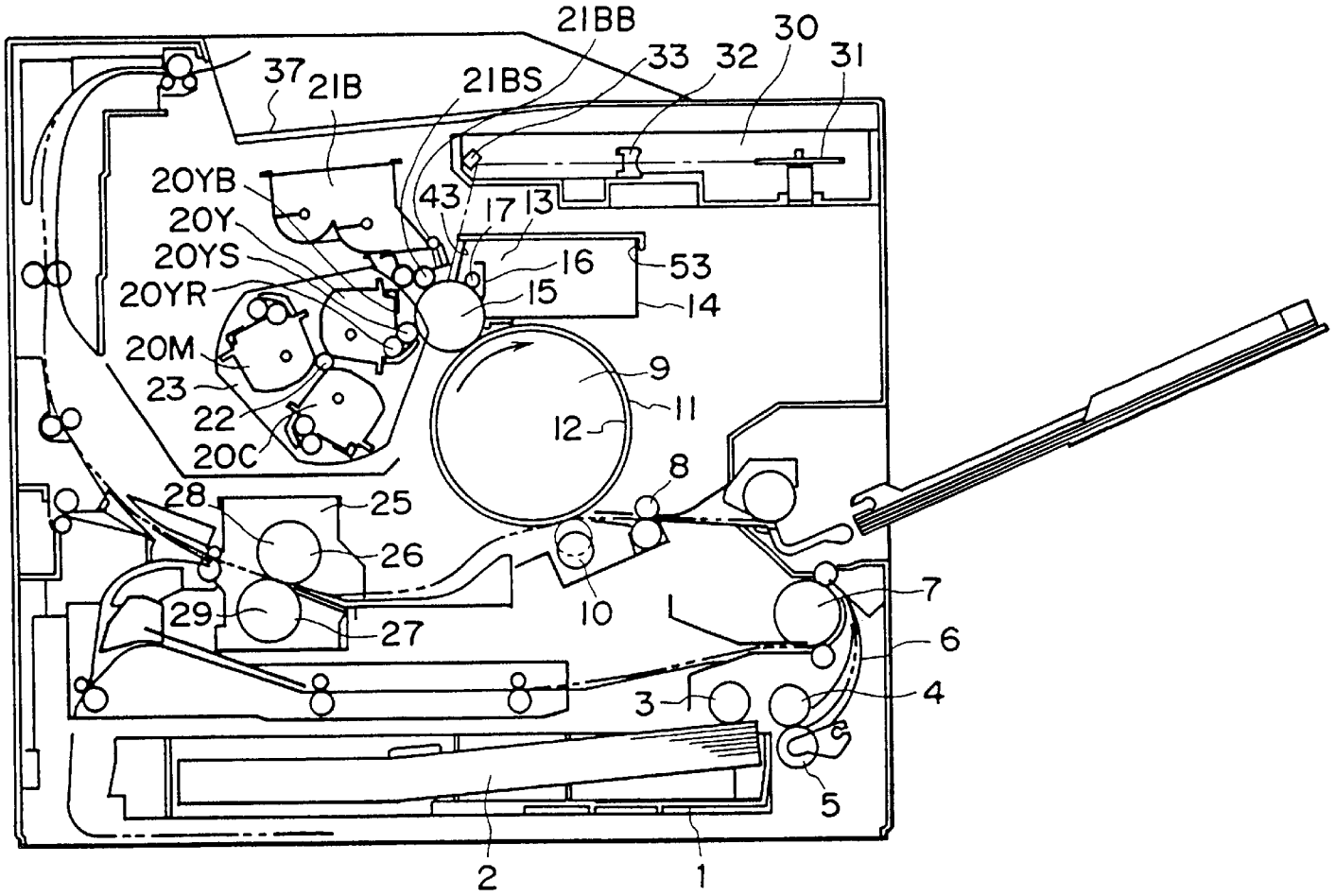
FIG. 1 is a schematic sectional view of a multi-color laser printer in accordance with the present invention.

Referring to FIG. 1, the general structure of an image forming apparatus will be described.

FIG. 1 is a drawing which depicts the general structure of a laser printer, that is, a type of a full-color image forming apparatus.

As shown in FIG. 1, a full-color laser printer comprises: an image forming section, an intermediary transfer member 9, and a fixing section. The image forming section consists of an image bearing member which is rotated at a predetermined peripheral velocity, a black color developing device which is fixedly disposed, and three color developing devices which are movable to a predetermined image transfer position by the rotation of a developing device rotary which supports them. The intermediary transfer member 9 bears a full-color image composed of a plurality of toner images of different color, which have resulted from the development of latent images, and have been transferred in layers onto the intermediary transfer member 9. It also transfers the full-color image onto a piece of transfer medium 2 conveyed from a recording medium feeding section. The fixing section fixes the color image to the transfer medium 2 which has been conveyed, while bearing the color image, to the fixing section, after the color image transfer onto the transfer medium 2. Thereafter, the transfer medium 2 is discharged by discharge rollers into a delivery portion 37 located at the top of the image forming apparatus. The image forming apparatus is structured so that each of the aforementioned three color developing devices supported by the developing device rotary, and the stationary black developing device, are removably installable in-the main assembly of the printer, independently from each other.

Next, the structure of each of the essential sections of the image forming apparatus will be described in detail.

[Image Bearing Member Unit]

An image bearing member unit, that is, a drum unit 13 (drum cartridge) comprises an image bearing member 15 (photosensitive drum) and a cleaning apparatus housing 14, which also doubles as the image bearing member holder in which the image bearing member is supported. The drum unit 13 is structured so that it can be removably supported by the main assembly of the printer; it is enabled to be exchanged with a fresh unit according to the length of the service life of the image bearing member 15. In other words, in this embodiment, the image bearing member unit is disposed in a housing so that the image bearing member unit can be removably disposed in the printer main assembly; the image bearing member unit is manufactured in the form of a cartridge.

The image bearing member in this embodiment consists of an aluminum cylinder with an external diameter of approximately 60 mm, and an organic photoconductor layer coated on the peripheral surface of the aluminum cylinder, and is rotationally supported by the cleaning apparatus housing 14 which doubles as the holder for the image bearing member 15.

Along the peripheral surface of the image bearing member 15, a cleaning blade 16 and a primary charging means 17 are disposed. In an image forming operation, the image bearing member 15 is rotationally driven in the counterclockwise direction by transmitting the driving force from an unillustrated motor to one of the longitudinal ends of the image bearing member 15. This end is hidden behind the structure illustrated in FIG. 1.

[Charging Means]

The charging means in this embodiment is such a changing means that employs a contact type charging method, according to which the peripheral surface of the image bearing member 15 is uniformly charged by applying a voltage to an electrically conductive roller placed in contact with the peripheral surface of the image bearing member 15.

[Exposing Means]

The aforementioned image bearing member 15 is exposed by a scanning portion 30. More specifically, as image formation signals are sent to a laser diode, the laser diode projects an image forming beam modulated with the image formation signals, toward a polygonal mirror 31, which is being rotated at a high peripheral velocity by a scanner motor. The beam deflected by the polygonal mirror 31, passes through an image formation lens 32, and is deflected by a mirror 33, and projected onto the peripheral surface of the image bearing member 15, which is being rotated at a predetermined peripheral velocity. As a result, the peripheral surface of the image bearing member 15 is selectively exposed, and an electrostatic latent image is formed on the peripheral surface of the image bearing member 15.

[Developing Means]

A developing means is a means for visualizing the electrostatic latent image, and comprises three developing devices 20Y, 20M and 20C for developing yellow, magenta, and cyan colors, correspondingly, which are mounted on a developing device rotary, and a stationary black color developing device 21B.

The black color developing device 21B is stationarily disposed so that a microscopic gap (approximately 300 $\mu$m) is kept between the peripheral surface of the development sleeve 21BS and the peripheral surface of the image bearing member 15. It develops the latent image on the image bearing member 15 into a visible image composed of black toner (developer) with the use of black toner.

More specifically, the black color developing device 21B sends toner in the container to the adjacencies of the development sleeve 21BS, so that the toner is coated in a thin layer, while being triboelectrically charged, onto the peripheral surface of the development sleeve 21BS, which is being rotated in the clockwise direction indicated in the drawing. The coating is done by a blade 21BB, which is kept under pressure which works in a direction to press the blade 21BB upon the peripheral surface of the development sleeve 21BS. As a predetermined bias is applied to the development sleeve 21BS, a visible image which reflects the electrostatic latent image is composed of the toner, on the peripheral surface of the image bearing member 15.

The three developing devices 20Y, 20M and 20C are individually and removably held by a developing device rotary 23, which is rotatable about an axis 22. In an image forming operation, a pertinent developing device among the three developing devices is moved to a development position by rotating the developing device rotary 23 about the axis 22, where the peripheral surface of the pertinent device squarely faces the peripheral surface of the image bearing member 15, leaving a microscopic gap (approximately 300 μm) between the two surfaces, to form a visible image which corresponds to the electrostatic latent image on the image bearing member 15. In a full-color image forming operation, in particular, the developing device rotary 23 is rotated once for each rotation of the intermediary transfer member 9, to move the yellow, magenta, and cyan developing devices 20Y, 20M and 20C in this order to the development position to develop the pertinent electrostatic latent image. The electrostatic latent image correspondent to black color is developed after the development of the electrostatic latent image correspondent to cyan color.

FIG. 1 depicts a state in which the developing device 20Y is standing still after having been moved to the development position, by rotating the developing device rotary, where the peripheral surface of the developing device 20Y faces the image bearing member unit. In the developing device 20Y, the toner (developer) within the developing device 20Y is sent to the coating roller 20YR by the toner delivery mechanism, and is coated in a thin layer, while being triboelectrically charged, onto the peripheral surface of the development sleeve 20YS, which is being rotated in the direction indicated in the drawing. The coating is done by the coating roller 20YR, which is being rotated in the direction indicated in the drawing, and the blade 20YB which is kept under the pressure applied upon the blade 20YB in the direction of the development sleeve 20YS. Then, as a development bias is applied to the development sleeve 20YS, which is squarely facing the image bearing member 15 on which a latent image has been formed, the latent image is developed into a visible image composed of the toner. The same development process as this development process carried out in the yellow developing device 20Y is also carried out in the magenta and cyan developing devices 20M and 20C which have the same mechanism as the one in the developing device 20Y.

As any of the three developing devices 20Y, 20M and 20C, mounted in the developing device rotary is moved to the developing position, this development device comes in contact with the high voltage power source provided on the main assembly side of the printer, and the developing device driver also provided on the main assembly side of the printer. Then, a voltage is applied to the developing device to drive the developing device.

[Intermediary Transfer Member]

In an image forming operation, the intermediary transfer member 9 is rotationally driven in the clockwise direction indicated by an arrow mark in the drawing, at the same peripheral velocity as that of the image bearing member 15, to receive a toner image, a visual image which is formed on the image bearing member 15 by one of the development devices, and is to be transferred onto the intermediary transfer member 9. Thus, for the formation of a single full-color image, the intermediary transfer member-9 is rotated four times (once for each of four colors, Y, M, C and Bk) to receive in layers the four toner images of different color. After the transfer in layers of the multiple toner images, a piece of transfer medium 2 is fed between the intermediary transfer member 9, and the transfer roller 10 to which a voltage is being applied, and is conveyed forward by being pinched by the two members. As the transfer medium 2 is conveyed, the toner images of different color on the intermediary transfer member 9 are transferred all at once onto the transfer medium 2.

The intermediary transfer member 9 in this embodiment is a roller with a diameter of approximately 180 mm, and consists of an aluminum cylinder 12, and an elastic layer 11 coated on the peripheral surface of the aluminum cylinder 12. The material for the elastic layer 11 is sponge or rubber with an electrical resistance in an intermediary range. The intermediary transfer member 9 is rotationally supported and is rotationally driven by the driving force transmitted through a gear (unillustrated) fixed to one of its longitudinal ends.

[Cleaning Section]

The cleaning section is a section for removing the toner which remains on the image bearing member 15 after the transfer of a visual image, that is, an image composed of toner by the developing device, on the image bearing member 15. The removed toner, that is, waste toner, is collected in the cleaning apparatus housing 14. The amount of the waste toner collected in the housing 14 never becomes large enough to fill up the housing 14 before the service life of the image bearing member runs out. Thus, the collected waste toner is removed from the main assembly of the image forming apparatus, as the drum cartridge which comprises the cleaning apparatus housing 14 which also houses the image bearing member 15 is replaced with a fresh drum cartridge after the service life of the image bearing member 15 expires.

Figure 2:
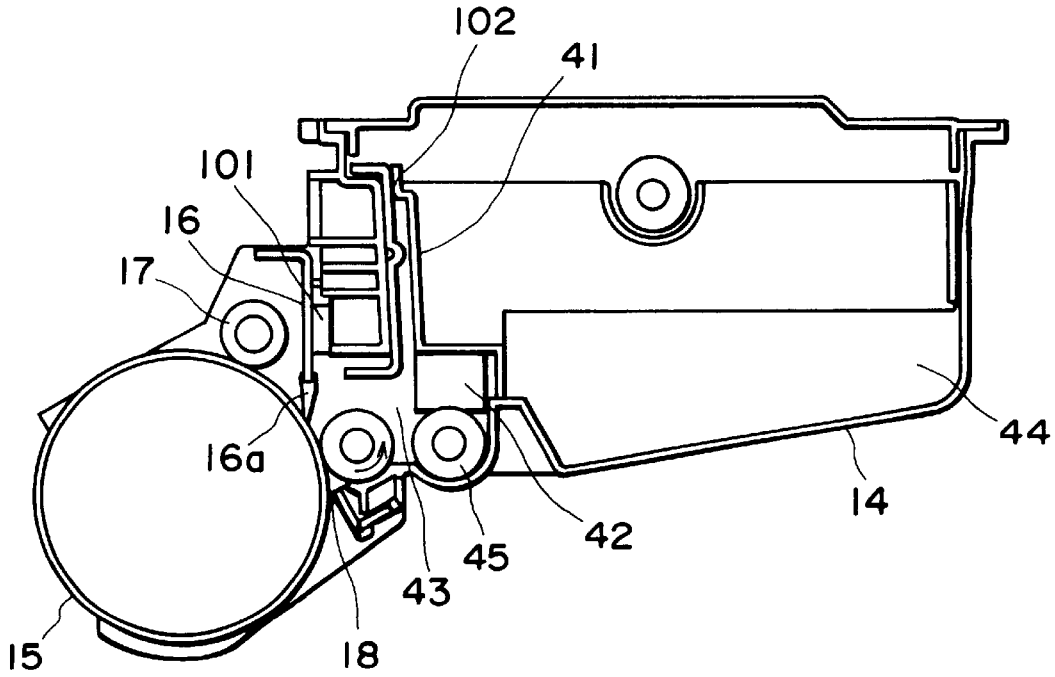
FIG. 2 is a schematic sectional view of a drum cartridge in accordance with the present invention.
Figure 3:
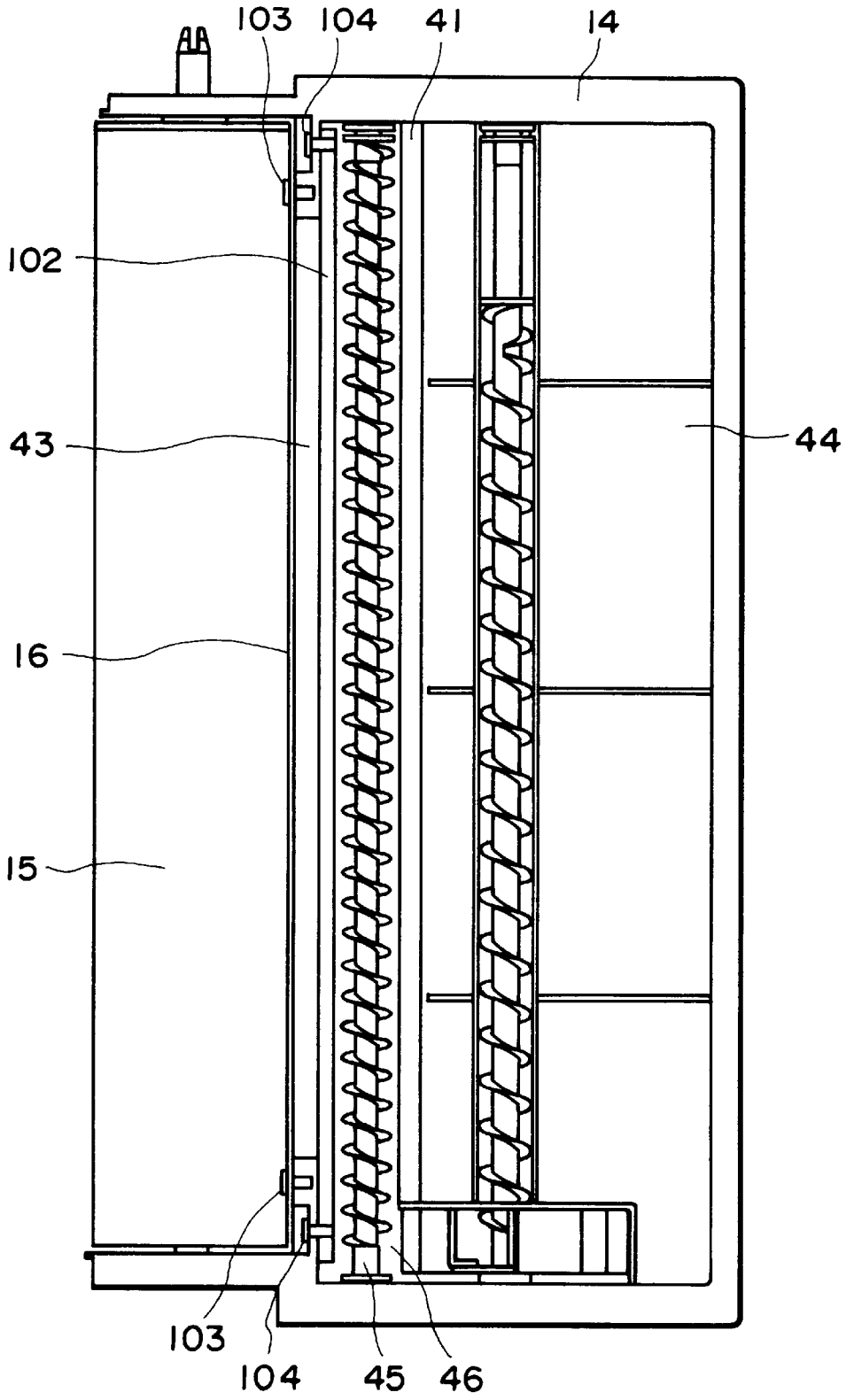
FIG. 3 is a plan view of the drum cartridge in the first embodiment of the present invention.
Figure 4:
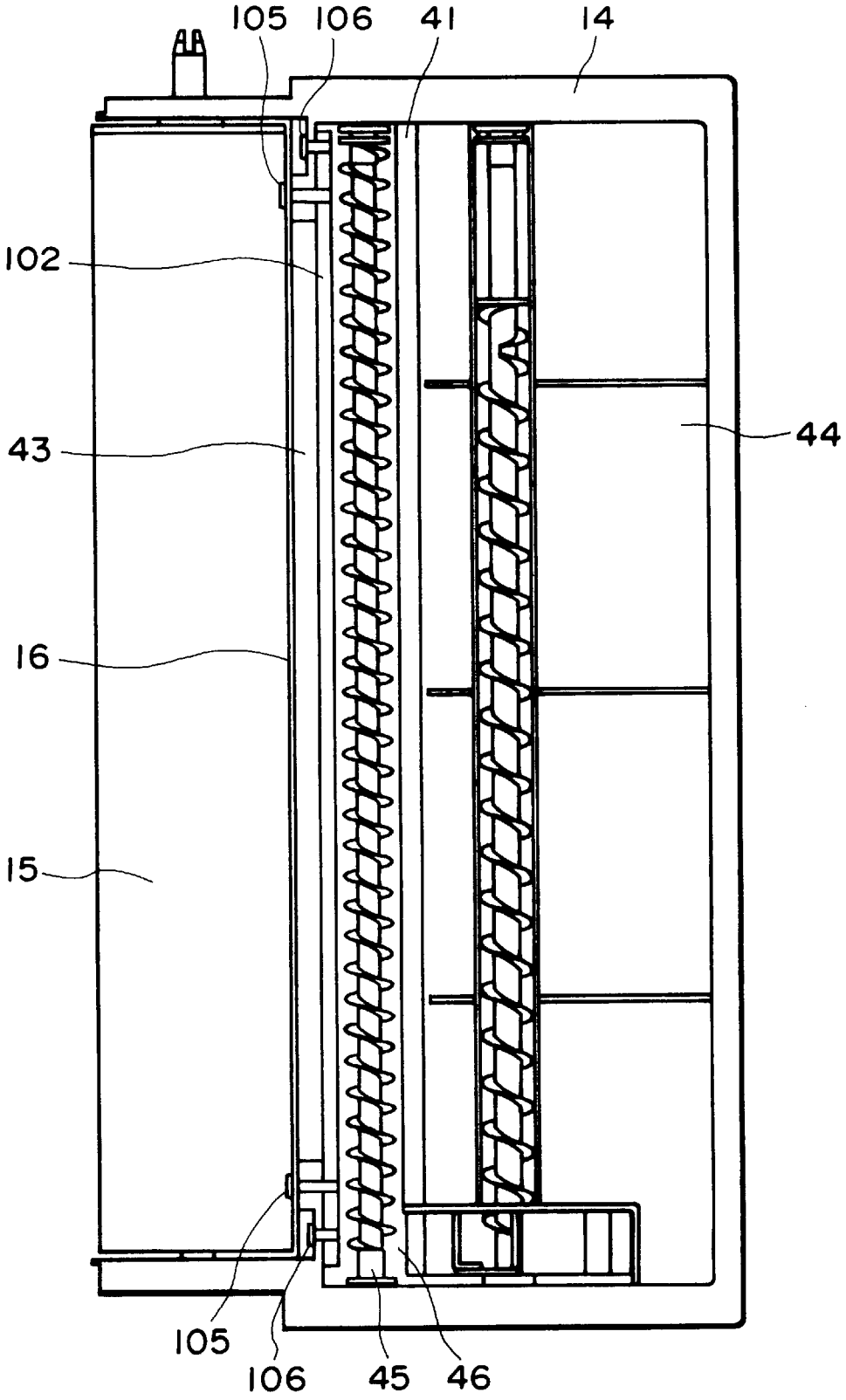
FIG. 4 is a plan view of the drum cartridge in the second embodiment of the present invention.

At this time, the cleaning section will be described in further detail with reference to FIGS. 3 and 4. In the cleaning apparatus housing 14, a cleaning blade 16 as a cleaning member for removing the waste toner on the image bearing member is disposed, and also, a partition wall 41, which partitions the internal space of the housing 14 into two chambers: a cleaning apparatus chamber 43 and a toner collection chamber 44 (waste developer chamber). Generally, the cleaning apparatus housing 14 is formed of resin. The cleaning blade 16 consists of a very rigid supporting portion (base portion) formed of metallic plate or the like, and an elastic edge portion (contact portion) which is formed of rubber or the like. It is placed in contact with the image bearing member 15, in such a manner that it extends in the direction counter to the rotational direction of the image bearing member 15. Adjacent to the partition wall 41, a screw 45 is disposed, which is rotationally driven to move the waste toner in the direction parallel to the longitudinal direction of the image bearing member 15. The partition wall 41 is provided with an opening 46, which is located adjacent to the delivery end portion of the screw 45. Adjacent to the opening 46, a pressure wall 42 (FIG. 2) a predetermined length is disposed, which fits around the circumference of the screw 45.

The cleaning apparatus housing 14 stores the waste toner removed from the peripheral surface of the image bearing member 15 (photosensitive drum) by the cleaning blade 16 after the aforementioned image transfer. More specifically, the waste toner is first caused to fall toward the bottom of the internal space of the cleaning apparatus housing 14, on the image bearing member side. Below the cleaning blade 16, a scooping sheet 18 (FIG. 2) is disposed in contact with the peripheral surface of the image bearing member 15, at a predetermined angle. The toner, which is on, or falls from, the peripheral surface of the image bearing member 15, is scooped into the cleaning apparatus chamber 43, and accumulates there. As the waste toner accumulates to the level of a developer conveying means constituted of the rotational screw 45, the portion of the waste toner, or waste developer, which has reached the screw 45, is conveyed in the direction parallel to the longitudinal direction of the image bearing member 15 by the rotation of the screw 45. The aforementioned opening 46 in the partition wall 41 which divides the internal space of the cleaning apparatus housing 14 into two chambers is a round hole, the diameter of which virtually coincides with the diameter of the screw 45, and which is located at the delivery end of the screw 45. Further, since the delivery end of the screw 45 is surrounded by the pressure wall 42, the waste toner, which has been delivered to this end, is increased in pressure as it is conveyed into the space surrounded by the pressure wall 42, and is forced into the waste toner collection chamber through the opening 46 in the partition wall 41. Although the spiral screw 45 in this embodiment is formed by molding, the method for forming the screw 45 is not limited to molding; any method may be employed as long as it can form a spiral screw. For example, the screw 45 may be in the form of a coil spring formed of metallic material. The delivery end portion of the screw 45, or the conveying means, surrounded by the pressure wall 42 functions as a means for preventing the waste toner from being allowed to move backward. Therefore, even if the drum cartridge is removed from, or reinstalled into, the main assembly of the image forming apparatus to replace a unit other than the drum cartridge, or to clean the main assembly, the waste toner, which has been collected in the waste toner collection chamber 44, does not contaminate the cleaning apparatus chamber.

The structure of the reinforcement member in accordance with the present invention will be described later.

[Sheet Feeding Section]

The sheet feeding section is a section from which the transfer medium 2 is delivered to the image forming section. It generally comprises a cassette 1 which holds plural sheets of transfer medium 2, a sheet feeder roller 3, a conveyor roller 4, a retarder roller 5 for preventing two or more sheets of transfer medium 2 from being fed at the same time, a sheet feeder guide 6, and a registration roller 8. In an image forming operation, the sheet feeder roller 3 is rotationally driven in synchronism with the image formation, to feed the sheets of transfer medium 2 into the main assembly of the image forming apparatus from the cassette 1, one by one while separating them. After being fed into the main assembly, the transfer medium 2 is guided by the sheet feeder guide 6, and is conveyed to the registration roller 8 by way of a conveyer roller 7. The registration roller 8 is intermittently driven so that the arrival of the leading edge of the transfer medium to the transfer position synchronizes with the arrival of the leading edge of a toner image formed on the image bearing member 15 to the transfer position, during a transfer process which follows the toner image formation process.

[Transfer Section]

The transfer section comprises a transfer roller 10 which can be locked into two different positions.

The transfer roller 10 consists of a metallic shaft and a layer of foamed elastic material wrapped around the metallic shaft, and is rotationally driven. It can be vertically moved as depicted in the drawing. While four toner images of different color are sequentially transferred onto the peripheral surface of the intermediary transfer member 9, in other words, while the intermediary transfer member 9 is rotated a plural number of times, the transfer roller 10 remains locked in the bottom position outlined by a thick solid line, being separated from the intermediary transfer member 9. After the transfer of the four toner images of different color onto the intermediary transfer member 9, the transfer roller 10 is moved to the top position outlined by a fine line in the drawing, by an unillustrated-cam, in synchronism with the delivery of the transfer medium 2 to the transfer position, so that the transfer medium 2 is pressed upon the intermediary transfer member 9 by the transfer roller 10. While the transfer roller 10 is at the top position, a bias is applied to the transfer roller 10. As a result, the toner images on the intermediary transfer member 9 are transferred onto the transfer medium 2. Since both the intermediary transfer member 9 and the transfer roller 10 are driven independently from each other, the transfer medium 2 pinched by the two rollers is conveyed, during this transfer period, in the leftward direction indicated in the drawing at a predetermined velocity, to a fixing device, in which the following process is carried out.

[Fixing Section]

A fixing section 25 is a section for fixing to the transfer medium 2, the toner images which have been formed by the aforementioned developing devices 20Y, 20M, 20C and 21B and have been transferred onto the transfer medium by way of the intermediary transfer member 9. As depicted in FIG. 1, it consists of a fixing roller 26 for applying heat to the transfer medium 2, and a pressure roller 27 for pressing the transfer medium 2 against the fixing roller 26. Both rollers are hollow, and contain heaters 28 and 29, respectively, and are rotationally driven to fix the toner images while conveying the transfer medium 2. Thus, as the transfer medium 2, which holds the toner images, is conveyed by the fixing roller 26 and pressure roller 27, the toner images are fixed to the transfer medium 2 by the application of heat and pressure.

Next, the reinforcement members in the cleaning section in accordance with the present invention will be described in detail.

The cleaning apparatus housing 14 houses the cleaning blade 16, which is fixed to the blade mounting wall 101, with the use of fixing members 103 such as small screws or the like, so that the elastic contact edge portion 16*a* of the cleaning blade 16 is placed in contact with the peripheral surface of the image bearing member 15 (photosensitive drum) in such a manner that the elastic contact edge portion 16*a* hypothetically invades the image bearing member 15 (photosensitive drum) by a predetermined depth. This blade mounting wall 101 is reinforced with a reinforcement member 102 fixed to the blade mounting wall 101 with the use of fixing members 104 such as small screws or the like, on the side opposite to where the cleaning blade 16 is fixed, that is, on the side where the cleaning apparatus chamber 43 and the toner collection chamber 44 are present. The reinforcement member 102 is formed of the same metallic plate or the like as the material of the supporting portion of the cleaning blade, or formed of such material that has the same coefficient of thermal expansion as that of the material of the supporting portion of the cleaning blade.

According to the above described structure, a member is pinched between two members formed of the material different in coefficient of thermal expansion from the material of the first member. Therefore, deformation such as the warping of the first member (blade mounting wall), that is, a phenomenon caused by the so-called bimetal effect, which occurs due to temperature fluctuation, does not occur. More specifically, the blade mounting wall 101 is pinched between the two members, that is, the supporting portion of the cleaning blade 16, and the reinforcement member 102. Therefore, the blade mounting wall 101 is prevented from deforming. In other words, the position to which the cleaning blade 16 is attached is prevented from shifting.

It should be noted here that the cleaning blade mounting position is caused to shift not only by heat as described above, but also by external physical force. For example, the cleaning blade mounting position is caused to shift as the cleaning apparatus housing 14 is twisted by external physical force. Thus, in order to more effectively prevent the shifting of the cleaning blade mounting position, the strength of the blade mounting wall 101 itself must be increased. However, the strength of the blade mounting wall 101 is limited by the characteristics of the material of the cleaning apparatus housing 14, that is, the material of the blade mounting wall 101, as long as the cleaning apparatus housing 14, or the blade mounting wall 101, is formed of resin. Thus, it is desired that the material for the reinforcement member has the same or greater strength than the material for the supporting portion of the cleaning member. The employment of such material as the material for the reinforcement member increases the resistance of the blade mounting wall 101 against external physical force, and therefore, the cleaning member mounting position is prevented from shifting due to twisting or the like deformation.

Further, according to this embodiment, the length of the reinforcement member is increased so that the longitudinal ends of the reinforcement member reach, or extend beyond, the corresponding longitudinal ends of the cleaning blade 16. It is preferable that the reinforcement member covers the entire length of cleaning apparatus housing 14. It is more preferable that the attachment points of the reinforcement member 102 to the cleaning apparatus housing 14 are on the outward side of the corresponding longitudinal ends of the blade mounting wall 101. With this arrangement, the resistance of the blade mounting wall 101 against the deformation caused by external physical force is further increased, and therefore, it is assured that the cleaning member mounting position is reliably prevented from shifting due to twisting or the like deformation.

Further, the reinforcement member in this embodiment is disposed within the waste developer chamber in which the waste developer is stored after it is removed by the cleaning member. With this arrangement, the cleaning member mounting position can be prevented from shifting, without increasing the process cartridge size.

Embodiment 2

Next, the second embodiment of the present invention regarding the reinforcement of the cleaning section will be described with reference to the drawings. In the drawings, the components which are the same in structure and function as those in the first embodiment will be given the same referential characters as those in the first embodiment, and their description will be omitted here.

In this embodiment, the cleaning blade 16 is fixed to the blade mounting wall 101, with the use of the same fixing members as those used to fix the reinforcement member 102 to the blade mounting wall 101. In other words, the cleaning blade 16 is attached to the blade mounting wall 101 with the use of fixing members 105 such as small screws or the like, which are screwed, or fastened, to the reinforcement member 102 itself, through the blade mounting wall 101 of the cleaning apparatus housing 14. In this case, the reinforcement member 102 may be fixed to the back side of the blade mounting wall 101 of the cleaning apparatus housing 14 with the use of fixing members 106 such as small screws or the like before the mounting of the cleaning blade 16 to the blade mounting wall 101.

With the above arrangement, even if the blade mounting wall 101 of the cleaning apparatus housing 14 cannot be provided with sufficient strength due to lack of space or the like reason, the positional accuracy of the cleaning blade is guaranteed by the blade mounting wall 101, and the strength of the blade mounting wall 101 is guaranteed by the reinforcement member 102. In other words, the positional accuracy of the cleaning blade 16 is guaranteed by two separate entities different in function.

As described above, according to one of the aspects of the present invention, a portion for supporting the cleaning member is reinforced with a reinforcement member, which is substantially the same in coefficient of thermal expansion as a cleaning member, and is attached to the supporting portion, on the side opposite to the cleaning member, so that the supporting portion is pinched between the cleaning member and the reinforcement member. Therefore, the supporting portion is far more resistant to factors, such as temperature fluctuation and/or external physical force, which affect the positional accuracy of the supporting portion. As a result, even if it is necessary to maintain the positional accuracy of the cleaning member at a much higher level than that expected in the past, it is assured that the cleaning member remains accurately positioned, maintaining a high level of cleaning performance. Thus, it is possible to always provide the users of an image forming apparatus in accordance with the present invention, with high quality images.

In the preceding embodiments of the present invention, the present invention was described with reference to an image forming apparatus in which a toner image is transferred onto a piece of transfer medium by way of an intermediary transfer member. However, the present invention is applicable as well to an image forming apparatus in which a toner image on the photosensitive drum is directly transferred onto a piece of transfer medium, that is, without the presence of an intermediary transfer member.

Further, in the preceding embodiments of the present invention, the present invention was described with reference to an image forming apparatus, which comprised a cleaning apparatus for removing and storing the toner which remains on the peripheral surface of the photosensitive member after toner image transfer. However, the present invention is applicable as well to an image forming apparatus, which comprises a cleaning apparatus for cleaning a member such as an intermediary transfer member for temporarily bearing a toner image.

The present invention is particularly effective when it is used with fine spherical toner particles such as polymerized toner particles.

While the invention has been described with reference to the structures disclosed herein, it is not confined to the details set forth and this application is intended to cover such modifications or changes as may come within the purposes of the improvements or the scope of the following claims.

What is claimed is:

1. A cleaning apparatus comprising:

a cleaning member for removing residual toner from an image bearing member, wherein said cleaning member includes a contact portion contacting said image bearing member and a base portion supporting said contact portion;

a supporting portion for supporting said cleaning member, said supporting portion being of a material different from that of said cleaning member; and a reinforcing member, wherein said reinforcing member is mounted to said supporting portion at a position opposed to a mounting position where said base portion is mounted to said supporting portion or outside the mounting position, wherein said base portion is mounted to said supporting portion, and wherein said reinforcing member and said cleaning member sandwiches said supporting portion.

2. An apparatus according to claim 1, wherein a difference between a coefficient of thermal expansion of said reinforcing member and that of said base portion is smaller than a difference between a coefficient of thermal expansion of said supporting portion and that of said base portion.

3. An apparatus according to claim 1, wherein said reinforcing member and said base portion are of the same material.

4. An apparatus according to claim 1, wherein said supporting portion is of resin material, and said reinforcing member and said base portion are of metal.

5. An apparatus according to claim 1, wherein said reinforcing member has a length which is larger than that of said base portion.

6. An apparatus according to claim 1, wherein said reinforcing member extends at least to a region where said reinforcing member is opposed to said base portion.

7. An apparatus according to claim 1, wherein said reinforcing member and said base portion are fixed to said supporting portion by a common fixing member.

8. An apparatus according to claim 1, wherein said reinforcing member is provided in a containing portion for containing toner removed by said cleaning member.

9. A process cartridge detachably mountable to a main assembly of an image forming apparatus, comprising:

an image bearing member;

a cleaning member for removing residual toner from the image bearing member, wherein said cleaning member includes a contact portion contacting said image bearing member and a base portion supporting said contact portion;

a supporting portion for supporting said cleaning member, said supporting portion being of a material different from that of said cleaning member;

a reinforcing member, wherein said reinforcing member is mounted to said supporting portion at a position opposed to a mounting position where said base portion is mounted to said supporting portion or outside the mounting position, wherein said base portion is mounted to said supporting portion, and wherein said reinforcing member and said cleaning member sandwiches said supporting portion.

10. A cartridge according to claim 9, wherein a difference between a coefficient of thermal expansion of said reinforcing member and that of said base portion is smaller than a difference between a coefficient of thermal expansion of said supporting portion and that of said base portion.

11. A cartridge according to claim 9, wherein said reinforcing member and said base portion are of the same material.

12. A cartridge according to claim 9, wherein said supporting portion is of resin material, and said reinforcing member and said base portion are of metal.

13. A cartridge according to claim 9, wherein said reinforcing member has a length which is larger than that of said base portion.

14. A cartridge according to claim 9, wherein said reinforcing member extends at least to a region where said reinforcing member is opposed to said base portion.

15. A cartridge according to claim 9, wherein said reinforcing member and said base portion are fixed to said supporting portion by a common fixing member.

16. A cartridge according to claim 9, wherein said reinforcing member is provided in a containing portion for containing toner removed by said cleaning member.

17. A cleaning apparatus comprising:

a cleaning member for removing residual toner from an image bearing member;

a housing having a mounting portion to which said cleaning member is mounted; and a reinforcing member mounted to said housing such that said mounting portion is interposed between said reinforcing member and said cleaning member.

18. An apparatus according to claim 17, wherein said cleaning member includes an elastic blade contacting said image bearing member and a supporting member supporting said elastic blade, said supporting member being mounted to said mounting portion.

19. An apparatus according to claim 18, wherein a difference between a coefficient of thermal expansion of said reinforcing member and that of said supporting member is smaller than a different between a coefficient of thermal expansion of said mounting portion and that of said supporting member.

20. An apparatus according to claim 18, wherein said reinforcing member and said supporting member are made of the same material.

21. An apparatus according to claim 18, wherein said mounting portion is made of a resin material, and said reinforcing member and said supporting member are made of a metal material.

22. An apparatus according to claim 18, wherein said reinforcing member has a length, which is larger than that of said supporting member in a longitudinal direction of said cleaning member.

23. An apparatus according to claim 18, wherein said reinforcing member extends at least to a region where said reinforcing member is opposed to said supporting member.

24. An apparatus according to claim 18, wherein said reinforcing member is fixed to said housing at a position opposed to a fixing position where said supporting member is fixed to said mounting portion or outside the fixing position.

25. An apparatus according to claim 18, wherein said reinforcing member and said supporting member are fixed to said mounting portion by a common fixing member.

26. An apparatus according to claim 17, wherein said mounting portion is made of a resin material, and said reinforcing member is made of a metal material.

27. An apparatus according to claim 17, wherein said reinforcing member is provided in a containing portion for containing toner removed by said cleaning member.

28. An apparatus according to any one of claims 17 through 27, wherein said cleaning apparatus constitutes a process cartridge which is detachably mountable to a main assembly of an image forming apparatus.

29. An apparatus according to any one of claims 17 through 27, wherein said cleaning apparatus is disposed in a process cartridge, which is detachably mountable to a main assembly of an image forming apparatus, and said process cartridge contains an image bearing member.

* * * * *

UNITED STATES PATENT AND TRADEMARK OFFICE

CERTIFICATE OF CORRECTION

PATENT NO. : 6,285,851 B1
DATED : September 4, 2001
INVENTOR(S) : Hisayoshi Kojima et al.

It is certified that error appears in the above-identified patent and that said Letters Patent is hereby corrected as shown below:

Column 1,
Line 37, "producable" should read -- producible --.

Column 3,
Line 66, "in-the" should read -- in the --.

Column 6,
Line 7, "member-9" should read -- member 9 --; and
Line 65, "(Fig. 2)" should read -- (Fig. 2) with --.

Column 8,
Line 17, "unillustrated-cam," should read -- unillustrated cam, --.

Column 11,
Line 54, "member;" should read -- member; and --.

Column 12,
Line 43, "different" should read -- difference --.

Signed and Sealed this

Ninth Day of April, 2002

*Attest:*

*Attesting Officer*

JAMES E. ROGAN
*Director of the United States Patent and Trademark Office*